US011289849B2

(12) United States Patent
Jani et al.

(10) Patent No.: US 11,289,849 B2
(45) Date of Patent: Mar. 29, 2022

(54) MAGNETIZED DATA CONNECTOR ASSEMBLY

(71) Applicants: Jayesh Jani, Battersea (GB); Harsha Jani, Battersea (GB)

(72) Inventors: Jayesh Jani, Battersea (GB); Harsha Jani, Battersea (GB)

( * ) Notice: Subject to any disclaimer, the term of this patent is extended or adjusted under 35 U.S.C. 154(b) by 0 days.

(21) Appl. No.: 16/923,755

(22) Filed: Jul. 8, 2020

(65) Prior Publication Data

US 2022/0013954 A1 Jan. 13, 2022

(51) Int. Cl.
*H01R 13/62* (2006.01)
*H01R 11/30* (2006.01)

(52) U.S. Cl.
CPC ..... *H01R 13/6205* (2013.01); *H01R 11/30* (2013.01)

(58) Field of Classification Search
CPC ..... H01R 13/6205; H01R 11/30
USPC ..... 439/39
See application file for complete search history.

(56) References Cited

U.S. PATENT DOCUMENTS 7,874,844 B1 * 1/2011 Fitts, Jr. ..... H01R 31/06 439/39
7,963,773 B2 * 6/2011 Palli ..... H01R 13/6205 439/38
8,351,178 B2 * 1/2013 Chen ..... H01R 13/639 361/144
8,517,766 B2 * 8/2013 Golko ..... H01R 25/00 439/607.41
8,790,120 B2 * 7/2014 Wang ..... G06F 1/1632 439/39
9,112,304 B2 * 8/2015 Rohrbach ..... G06F 1/18
9,300,081 B2 * 3/2016 Rudisill ..... H01R 13/6205
9,362,664 B2 * 6/2016 Yen ..... H01R 13/6205
9,461,403 B2 * 10/2016 Gao ..... H01R 13/17
9,515,420 B2 * 12/2016 Daoura ..... H01R 13/642
D795,816 S 8/2017 He
9,780,484 B2 * 10/2017 DiFonzo ..... H01R 43/26
9,935,408 B1 * 4/2018 Pathak ..... H01R 24/60
9,979,138 B1 * 5/2018 Chen ..... H01R 13/7137
9,991,628 B2 * 6/2018 Daoura ..... H01R 13/64
10,297,950 B2 * 5/2019 Wei ..... H05K 1/181
10,320,136 B2 * 6/2019 Michelmann ..... H01R 31/06
10,333,249 B1 * 6/2019 Wang ..... H01R 13/6205
10,361,509 B1 * 7/2019 Ananthapur Bache ..... G05B 19/0428
10,707,610 B1 * 7/2020 Wang ..... H01R 39/64
11,025,002 B1 * 6/2021 Zhang ..... H01R 13/6205
11,050,197 B1 * 6/2021 Higgins ..... G01B 7/003

* cited by examiner

*Primary Examiner* — Alexander Gilman

(57) ABSTRACT

A magnetized data connector assembly includes a male data coupler that is insertable into a female data port on a first electronic device. A female data coupler is engageable to a male data port on a second electronic device. The female data coupler releasably engages the male data coupler thereby facilitating the female data coupler to disengage from the male data coupler. In this way each of the male data coupler and the female data coupler inhibit the female data port and the male data port from being damaged. Moreover, the first female data port is in electrical communication with the first male data port to facilitating electronic communication between the first electronic device and the second electronic device.

7 Claims, 7 Drawing Sheets

MAGNETIZED DATA CONNECTOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to data connector device and more particularly pertains to a new data connector device for releasably connecting a first electronic device to a second electronic device.

(2) Description of Related Art Including Information Disclosed Under 37 CFR 1.97 and 1.98

The prior art relates to data connector devices including a data coupler that includes a magnetic switch for automatically disconnecting the data coupler from an electronic device. The prior art also discloses a data coupler that has magnetized electrical contacts for releasably attaching the data coupler to a data port. The prior art discloses a data coupler that comprises a plurality of body sections, including a magnetized portion for releasably coupling the plurality of body sections together. The prior art discloses a data cable that has pair of data couplers each being oriented perpendicularly to the data cable. Additionally, the prior art discloses a data cable that has a magnetically retained plug on one end to facilitate a breakaway connection between electronic devices.

BRIEF SUMMARY OF THE INVENTION

An embodiment of the disclosure meets the needs presented above by generally comprising a male data coupler that is insertable into a female data port on a first electronic device. A female data coupler is engageable to a male data port on a second electronic device. The female data coupler releasably engages the male data coupler thereby facilitating the female data coupler to disengage from the male data coupler. In this way each of the male data coupler and the female data coupler inhibit the female data port and the male data port from being damaged. Moreover, the first female data port is in electrical communication with the first male data port to facilitating electronic communication between the first electronic device and the second electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
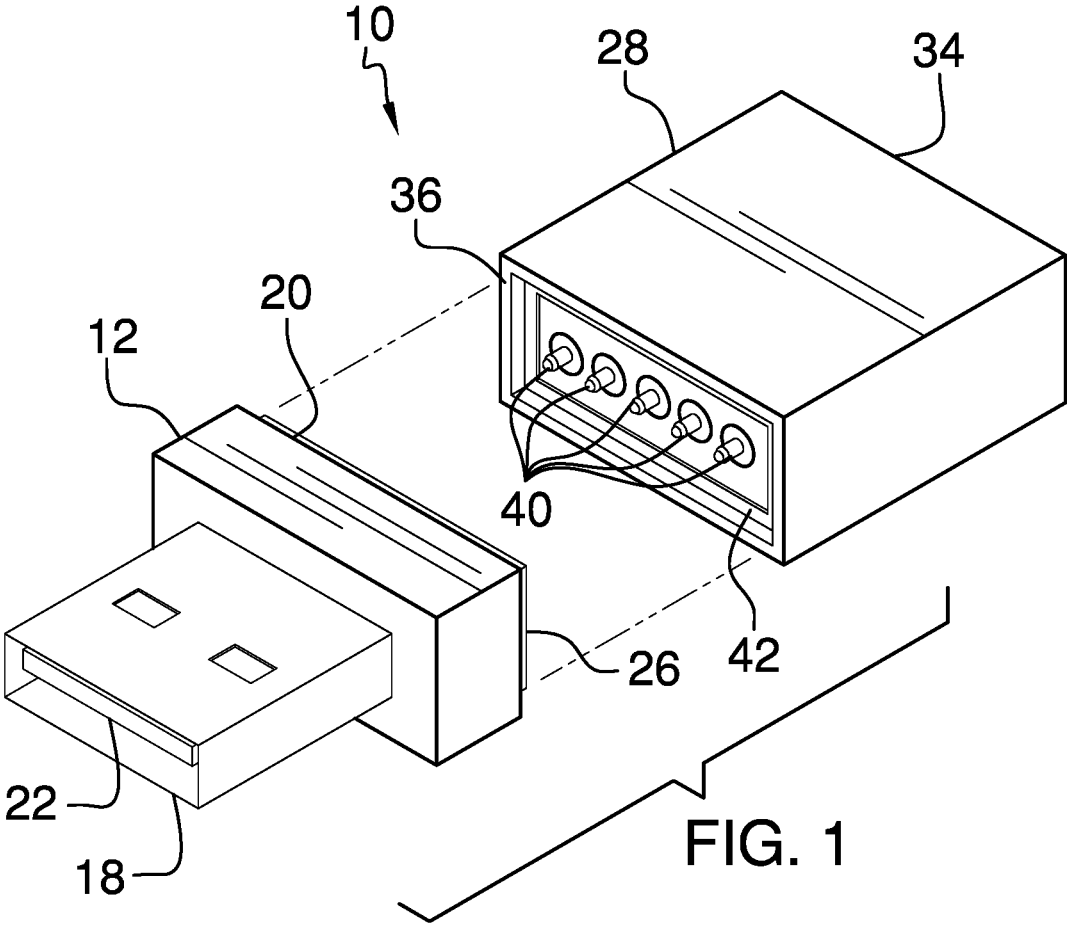
FIG. 1 is a perspective view of a magnetized data connector assembly according to an embodiment of the disclosure.

With reference now to the drawings, and in particular to FIGS. 1 through 9 thereof, a new data connector device embodying the principles and concepts of an embodiment of the disclosure and generally designated by the reference numeral 10 will be described.

As best illustrated in FIGS. 1 through 9, the magnetized data connector assembly 10 generally comprises a male data coupler 12 that is insertable into a female data port 14 on a first electronic device 16. In this way the male data coupler 12 is placed in electronic communication with the first electronic device 16. The first electronic device 16 may be a personal computer, a multimedia device or any other similar type of electronic device. Additionally, the female data port 14 may be a female usb port, a female HDMI port or any other type of female data port 14 commonly found on electronic devices.

The male data coupler 12 has a front end 18 and a back end 20, and the front end 18 is insertable into the female data port 14. The front end 18 has a front contact 22 integrated therein and the front contact 22 is in electrical communication with the first electronic device 16 when the front end 18 is inserted into the female data port 14. The back end 20 has a plurality of back contacts 24 coupled thereto and each of the back contacts 24 is electrically coupled to the front contact 22. In this way each of the back contacts 24 is in electrical communication with the first electronic device 16 when the male data coupler 12 is plugged into the female data port 14.

As is most clearly shown in FIGS. 1, 2, 3 and 4, the front end 18 of the male data coupler 12 may comprise a male usb connector. As is most clearly shown in FIG. 6, the front end 18 of the male data coupler 12 may comprise a male HDMI connector. As is most clearly shown in FIG. 7, the male data coupler 12 may comprise a male ¼ inch stereo jack. A first magnet 26 is provided and the first magnet 26 is coupled to the male data coupler 12. The first magnet 26 is positioned on the back end 20 of the male data coupler 12 and the first magnet 26 may surround each of the back contacts 24.

A female data coupler 28 is provided and the female data coupler 28 is engageable to a male data port 30 on a second electronic device 32. In this way the female data coupler 28 is placed in electrical communication with the second electronic device 32. The second electronic device 32 may be a data storage device such as a flash drive or the like, a peripheral electronic device that is commonly employed with a personal computer, or any other similar type of electronic device. Moreover, the female data coupler 28 releasably engages the male data coupler 12 thereby facilitating the female data coupler 28 to disengage from the male data coupler 12. In this way each of the male data coupler 12 and the female data coupler 28 inhibit the female data port 14 and the male data port 30 from being damaged. The female data coupler 28 is in electrical communication with the male data coupler 12 when the female data coupler 28 releasably engages the male data coupler 12. In this way electronic communication is facilitated between the first electronic device 16 and the second electronic device 32.

The female data coupler 28 has a forward end 34 and a rear end 36, and the forward end 34 has a forward contact 38 integrated therein. In this way the forward contact 38 is in electrical communication with the second electronic device 32 when the female data coupler 28 is plugged into the male data port 30. The rear end 36 has a plurality of rear contacts 40 each being coupled thereto and each of the rear contacts 40 is in electrical communication with the forward contact 38. In this way each of the rear contacts 40 is in electrical communication with the second electronic device 32 when the female data coupler 28 is plugged into the male data port 30. Each of the rear contacts 40 electrically engages a respective one of the back contacts 24 on the male data coupler 12. Each of the rear contacts 40 may comprise a spring loaded pin that is biased to extend outwardly from the rear end 36 or other similar type of movable contact.

Figure 2:
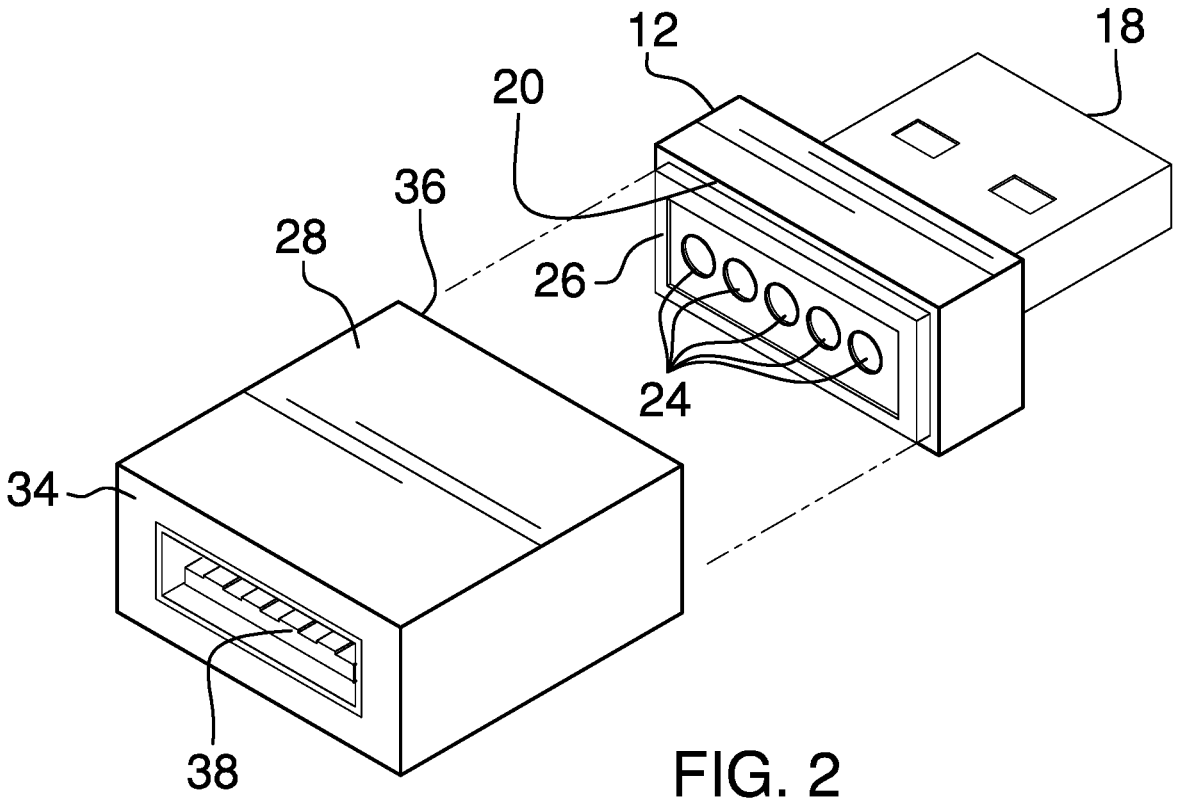
FIG. 2 is a top perspective view of an embodiment of the disclosure.
Figure 3:
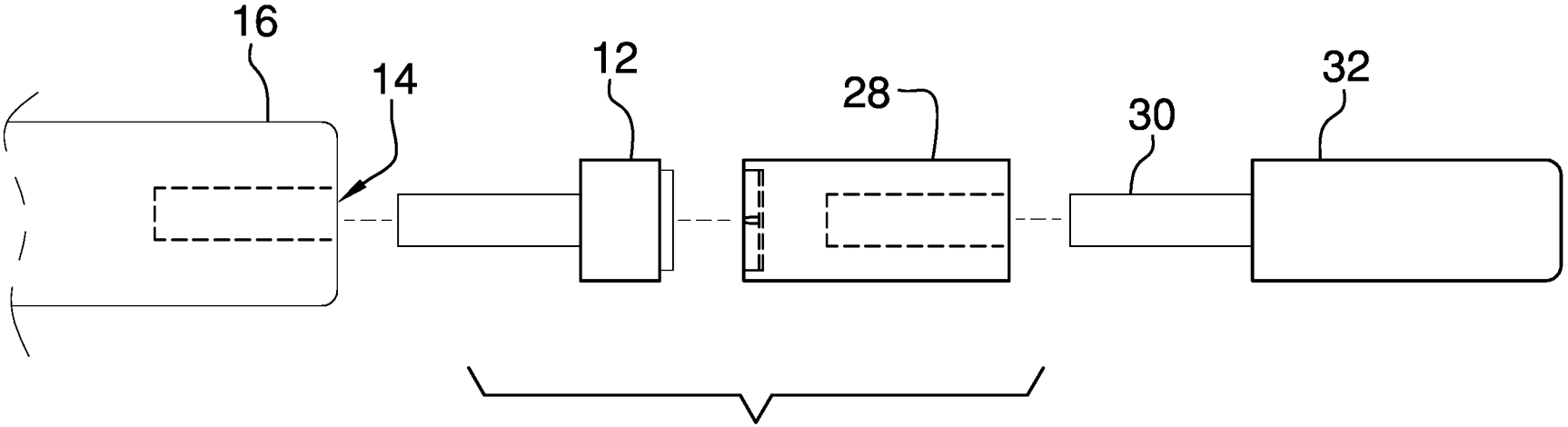
FIG. 3 is an exploded in-use view of an embodiment of the disclosure.
Figure 4:
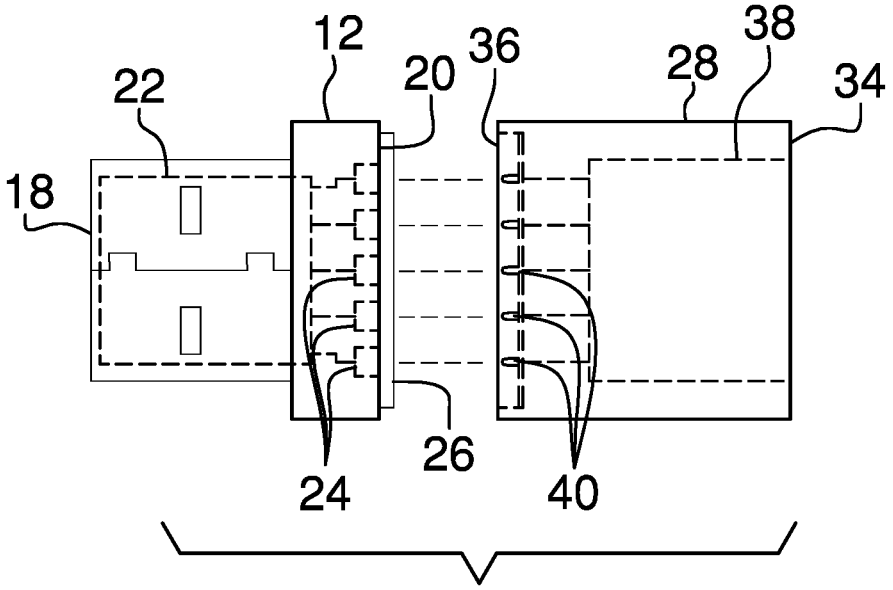
FIG. 4 is a top phantom view of an embodiment of the disclosure.

As is most clearly shown in FIGS. 2, 3 and 4, the female data coupler 28 may comprise a female usb connector. As is most clearly shown in FIG. 6, the female data coupler 28 may comprise a female HDMI connector. As is most clearly shown in FIG. 7, the female data coupler 28 may comprise a female ¼ inch stereo jack. A second magnet 42 is coupled to the female data coupler 28 and the second magnet 42 is positioned on the rear end 36 of the female data coupler 28. The second magnet 42 magnetically engages the first magnet 26 for releasably coupling the female data coupler 28 to the male data coupler 12. Additionally, the second magnet 42 may surround each of the rear contacts 40. Each of the rear contacts 40 and the second magnet 42 may be recessed into the rear end 36 of the female data coupler 28 for enhancing engaging the male data coupler 12 to the female data coupler 28.

Figure 5:
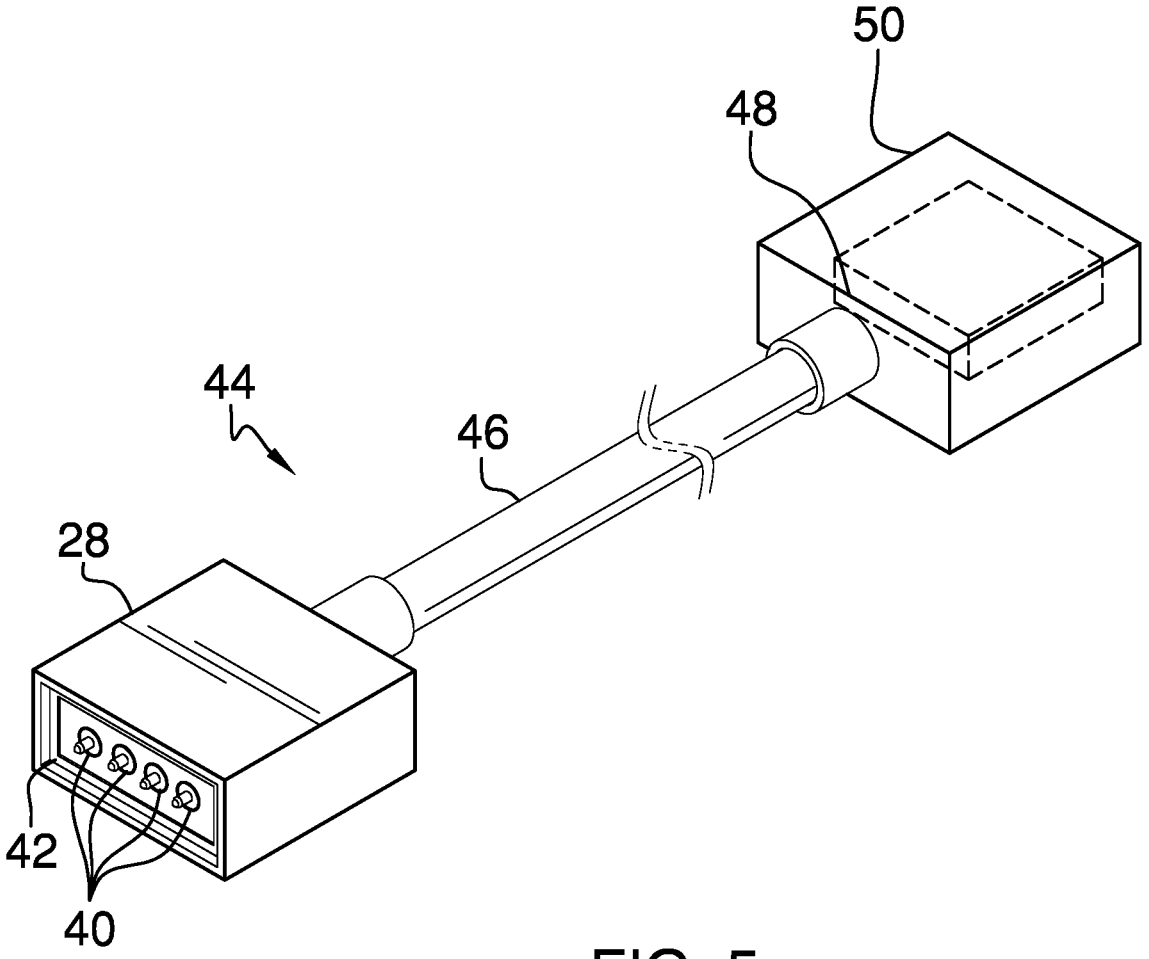
FIG. 5 is a perspective view of an alternative embodiment of the disclosure.
Figure 6:
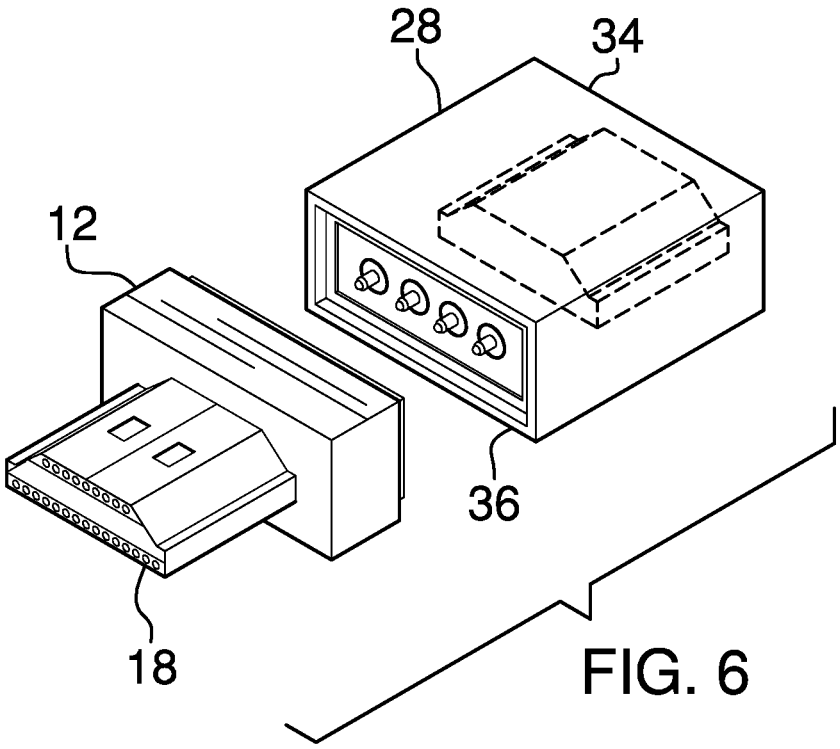
FIG. 6 is a perspective phantom view of an embodiment of the disclosure.
Figure 7:
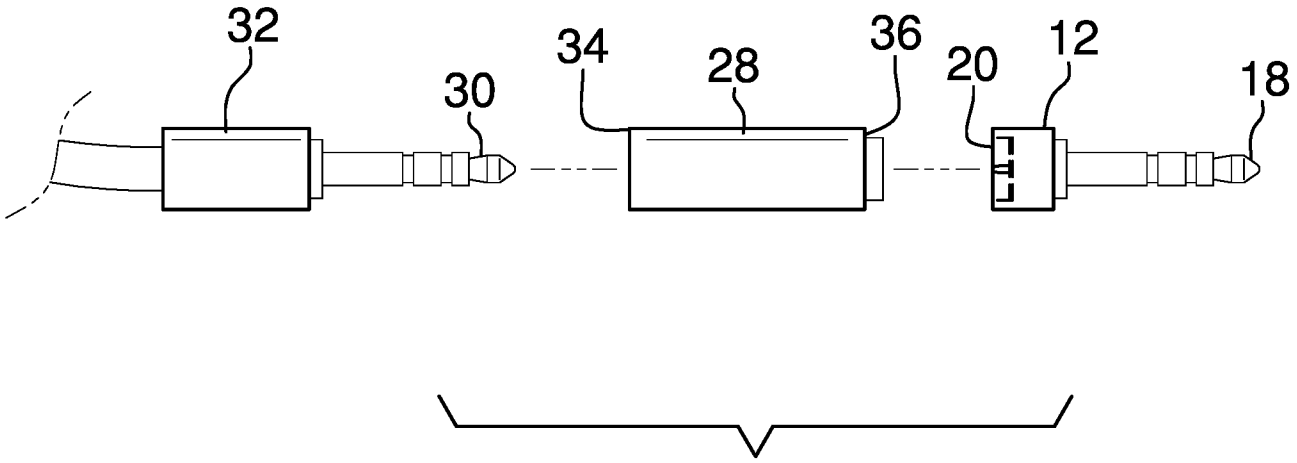
FIG. 7 is an exploded perspective view of an embodiment of the disclosure.

In an alternative embodiment 44 as is most clearly shown in FIG. 5, a conductor 46 is coupled to and extends away from the female data coupler 28. The conductor 46 is in electrical communication with the female data coupler 28. Additionally, the conductor 46 is engageable with the male data port 30 in the first electronic device 16 thereby facilitating electrical communication between the first electronic device 16 and the female data coupler 28. The conductor 46 has a distal end 48 with respect to the female data coupler 28 and the conductor 46 is elongated between the female data coupler 28 and the distal end 48. Moreover, the distal end 48 may have a female data plug 50 electrically coupled thereto for engaging the male data port 30. In this way the conductor 46 facilitates the distance between the first electronic device 16 and the second electronic device 32 to be increased when the first electronic device 16 is in electrical communication with the second electronic device 32.

Figure 8:
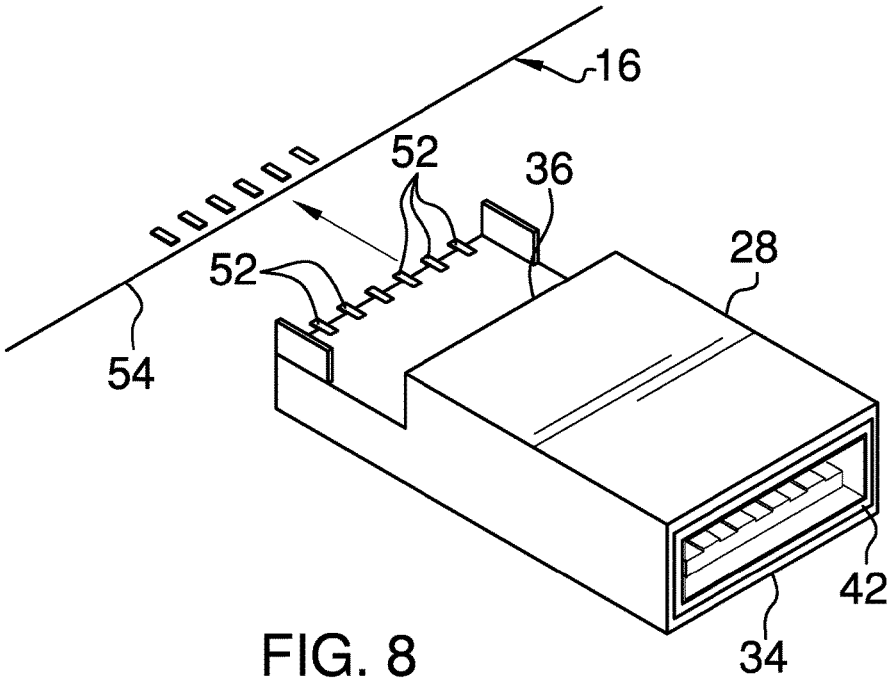
FIG. 8 is a perspective view of alternative embodiment of a female data port of an embodiment of the disclosure.

As is most clearly shown in FIG. 8, the rear end 36 of the female data coupler 28 may have a plurality of solder pins 52 each being coupled thereto. Each of the solder pins 52 is in electrical communication with the forward contact 38. Each of the solder pins 52 may be soldered directly to a circuit board 54 of the first electronic device 16. In this way the female data coupler 28 is an integral component of the first electronic device 16. Additionally, the second magnet 42 may be positioned on the forward end 34 of the female data coupler 28. In this way the male data coupler 12 can releasably engage the female data coupler 28.

Figure 9:
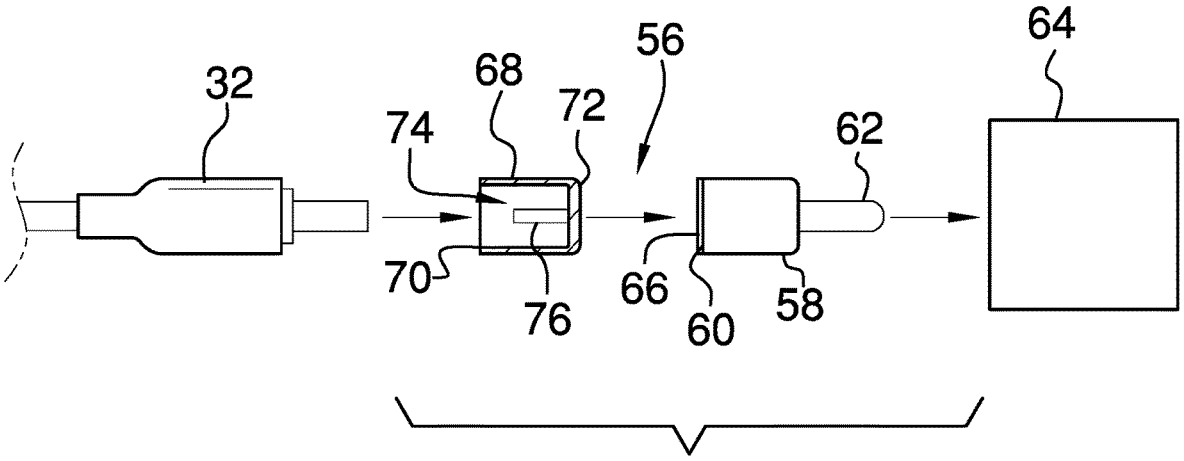
FIG. 9 is a perspective view of a DC power adapter of an embodiment of the disclosure.

As is most clearly shown in FIG. 9, a DC power adapter 56 may be provided that includes a coupled portion 58 that has a front end 60 and a back end 62, and the back end 62 of the coupled portion 58 may be electrically coupled to a power circuit of an extrinsic electronic device 64. Additionally, the front end 60 of the coupled portion 58 may have a third magnet 66 coupled thereto. The DC power adapter 56 may include a sleeve portion 68 that has a forward end 70 and a rear end 72, and the rear end 72 of the sleeve portion 68 can magnetically engage the third magnet 66. The forward end 70 may have a well 74 extending therein and a contact 76 that is positioned in the well 74. The contact 76 is in electrical communication with the coupled portion 58 when the sleeve portion 68 magnetically engages the coupled portion 58. In this way a power plug 78 of a DC power supply can be plugged into the sleeve portion 68 for releasably coupling the DC power supply to the extrinsic electronic device 64.

In use, the male data coupler 12 is plugged into the female data port 14 on the first electronic device 16 and the female data coupler 28 is plugged into the male data port 30 on the second electronic device 32. The back end 20 of the male data coupler 12 is mated to the rear end 36 of the female data coupler 28. In this way the first electronic device 16 is placed in electrical communication with the second electronic device 32. Moreover, the magnetic coupling between the male data coupler 12 and the female data coupler 28 facilitates the male data coupler 12 to break away from the female data coupler 28 when either of the first electronic device 16 or the second electronic device 32 is dropped, bumped or otherwise disturbed. In this way the male data port 30 and the female data port 14 are inhibited from being damaged as is commonly the case with existing usb plugs, HDMI plugs and other types of data plugs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A magnetized data connector assembly for facilitating a breakaway data connection between electronic devices, said assembly comprising:

a male data coupler being insertable into a female data port on a first electronic device wherein said male data coupler is configured to be in electronic communication with the first electronic device;

a first magnet being coupled to said male data coupler and extending from a back end of said male data coupler;

a female data coupler being engageable to a male data port on a second electronic device wherein said female data coupler is configured to be in electrical communication with the second electronic device, said female data coupler releasably engaging said male data coupler thereby facilitating said female data coupler to disengage from said male data coupler wherein each of said male data coupler and said female data coupler are configured to inhibit the female data port and the male data port from being damaged, said first female data port being in electrical communication with said first male data port when said first female data port releasably engages the first male data port thereby facilitating electronic communication between the first electronic device and the second electronic device; and a second magnet being coupled to said female data coupler, said second magnet being inset into a rear end of said female data coupler, said second magnet directly contacting said first magnet when said first magnet is inserted into said rear end of said female data coupler to magnetically engage said second magnet for releasably coupling said female data coupler to said female data coupler.

2. The assembly according to claim 1, wherein said male data coupler has a front end, said back end being insertable into the female data port, said front end having a front contact being integrated therein wherein said front contact is configured to be in electrical communication with the first electronic device when said front end is inserted into the female data port.

3. The assembly according to claim 2, wherein said back end has a plurality of back contacts being coupled thereto, each of said back contacts being electrically coupled to said front contact wherein each of said back contacts is configured to be in electrical communication with the first electronic device.

4. The assembly according to claim 1, wherein said female data coupler has a forward end, said forward end having a forward contact being integrated therein wherein said forward contact is configured to be in electrical communication with the second electronic device.

5. The assembly according to claim 4, wherein:

said male data coupler has a front contact and a plurality of back contacts, each of said back contacts being electrically coupled to said front contact wherein each of said back contacts is configured to be in electrical communication with the first electronic device; and said rear end has a plurality of rear contacts each being coupled thereto, each of said rear contacts being in electrical communication with said forward contact wherein each of said rear contacts is configured to be in electrical communication with the second electronic device, each of said rear contacts electrically engaging a respective one of said back contacts on said male data coupler.

6. A magnetized data connector assembly for facilitating a breakaway data connection between electronic devices, said assembly comprising:

a male data coupler being insertable into a female data port on a first electronic device wherein said male data coupler is configured to be in electronic communication with the first electronic device, said male data coupler having a front end and a back end, said front end being insertable into the female data port, said front end having a front contact being integrated therein wherein said front contact is configured to be in electrical communication with the first electronic device when said front end is inserted into the female data port, said back end having a plurality of back contacts being coupled thereto, each of said back contacts being electrically coupled to said front contact wherein each of said back contacts is configured to be in electrical communication with the first electronic device;

a first magnet being coupled to said male data coupler, said first magnet being positioned on and extending from said back end of said male data coupler;

a female data coupler being engageable to a male data port on a second electronic device wherein said female data coupler is configured to be in electrical communication with the second electronic device, said female data coupler releasably engaging said male data coupler thereby facilitating said female data coupler to disengage from said male data coupler wherein each of said male data coupler and said female data coupler are configured to inhibit the female data port and the male data port from being damaged, said female data coupler being in electrical communication with said male data coupler when said female data coupler releasably engages the male data coupler thereby facilitating electronic communication between the first electronic device and the second electronic device, said female data coupler having a forward end and a rear end, said forward end having a forward contact being integrated therein wherein said forward contact is configured to be in electrical communication with the second electronic device, said rear end having a plurality of rear contacts each being coupled thereto, each of said rear contacts being in electrical communication with said forward contact wherein each of said rear contacts is configured to be in electrical communication with the second electronic device, each of said rear contacts electrically engaging a respective one of said back contacts on said male data coupler; and a second magnet being coupled to said female data coupler, said second magnet being inset into said rear end of said female data coupler, said second magnet directly contacting said first magnet when said first magnet is inserted into said rear end of said female data coupler to magnetically engage said second magnet for releasably coupling said female data coupler to said female data coupler.

7. The assembly according to claim 6, further comprising a conductor being coupled to and extending away from said female data coupler, said conductor being in electrical communication with said female data coupler, said conductor being engageable with the male data port in the first electronic device thereby facilitating electrical communication between the first electronic device and said female data coupler, said conductor having a distal end with respect to said female data coupler, said conductor being elongated between said female data coupler and said distal end wherein said conductor is configured to increase the distance between the first electronic device and the second electronic device when the first electronic device is in electrical communication with the second electronic device.

* * * * *